US009206570B2

(12) United States Patent
Knight et al.

(10) Patent No.: US 9,206,570 B2
(45) Date of Patent: Dec. 8, 2015

(54) FLOATING MARINE DOCK AND CONNECTION SYSTEM THEREFOR

(71) Applicants: Douglas J. Knight, Deer Park, WA (US); Kenneth L. Knight, Deer Park, WA (US); David A. Knight, Deer Park, WA (US); David Drahman, Deer Park, WA (US)

(72) Inventors: Douglas J. Knight, Deer Park, WA (US); Kenneth L. Knight, Deer Park, WA (US); David A. Knight, Deer Park, WA (US); David Drahman, Deer Park, WA (US)

(73) Assignee: Knight Boat Docks, LLC, Deer Park, WA (US)

( * ) Notice: Subject to any disclaimer, the term of this patent is extended or adjusted under 35 U.S.C. 154(b) by 170 days.

(21) Appl. No.: 13/927,567

(22) Filed: Jun. 26, 2013

(65) Prior Publication Data

US 2014/0174332 A1 Jun. 26, 2014

Related U.S. Application Data

(60) Provisional application No. 61/664,093, filed on Jun. 25, 2012.

(51) Int. Cl.

| | |
|---|---|
| ***B63B 35/34*** | (2006.01) |
| ***B63B 35/38*** | (2006.01) |
| ***B63B 35/44*** | (2006.01) |
| ***E02B 3/06*** | (2006.01) |
| ***B63B 3/08*** | (2006.01) |

(52) U.S. Cl.

CPC . *E02B 3/064* (2013.01); *B63B 3/08* (2013.01); *B63B 35/38* (2013.01); *B63B 2221/00* (2013.01)

(58) Field of Classification Search

CPC ..... E02B 3/064; B63C 1/02; B63B 3/08; B63B 35/38; B63B 35/34; B63B 35/58; B63B 2221/00; B63B 35/44

USPC ..... 114/263, 264, 266, 267

See application file for complete search history.

(56) References Cited

U.S. PATENT DOCUMENTS

| | | | | |
|---|---|---|---|---|
| 4,926,776 | A * | 5/1990 | Corbett | 114/263 |
| 5,281,055 | A * | 1/1994 | Neitzke et al. | 405/219 |
| 6,783,303 | B2 * | 8/2004 | Snyder | 405/212 |
| 7,845,300 | B1 * | 12/2010 | Stroud | 114/263 |
| 8,292,547 | B2 * | 10/2012 | Johanneck et al. | 405/219 |
| 2004/0018054 | A1 * | 1/2004 | Rueckert | 405/7 |
| 2005/0254892 | A1 * | 11/2005 | Yodock et al. | 404/6 |
| 2010/0012011 | A1 * | 1/2010 | Gerst et al. | 114/263 |

* cited by examiner

*Primary Examiner* — Anthony West
(74) *Attorney, Agent, or Firm* — Dorsey & Whitney LLP

(57) ABSTRACT

A floating marine dock and connection system there for provides plural elongate rectilinear flotation pontoons having a consistent peripheral configuration with a major dimension and a minor dimension and customizable lengths. Connection apparatus interconnected to the flotation pontoons permits the flotation pontoons to be interconnected end-to-end, in parallel, perpendicular to, and spaced apart from one another. Connection straps extend about the outer periphery of the flotation pontoons and interconnect with flanges, plates and accessories desirable for marine docks. The connection straps support a nailer beam to which decking is fastened. Braces extend between spacedly adjacent flotation pontoons to maintain the spatial relationship therebetween and to support service conduits.

20 Claims, 15 Drawing Sheets

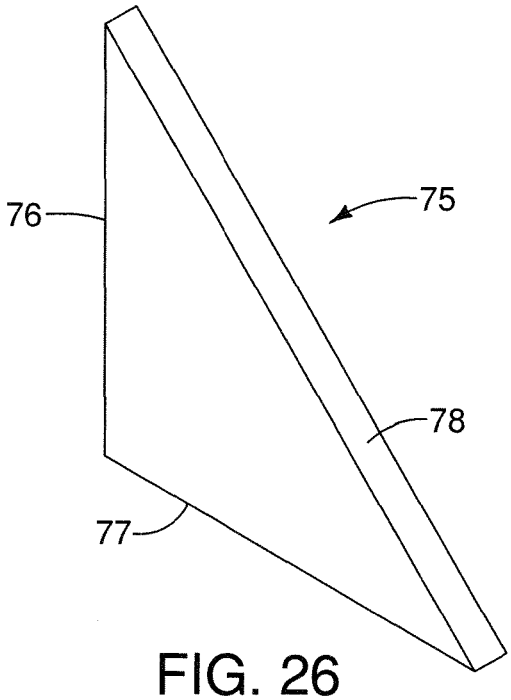
FIG. 26
FIG. 27
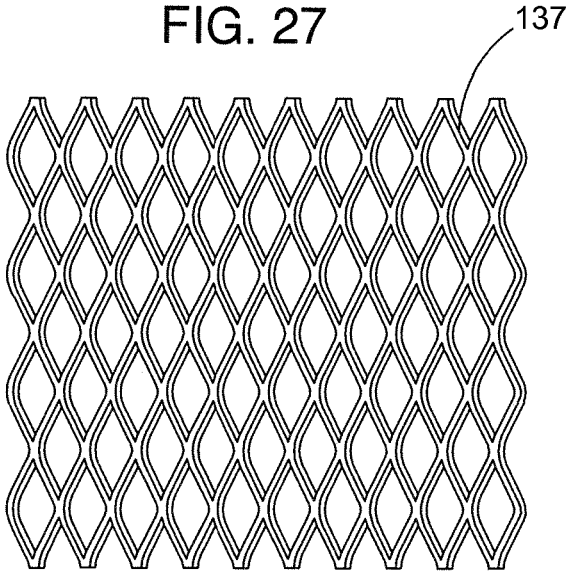

FLOATING MARINE DOCK AND CONNECTION SYSTEM THEREFOR

RELATED APPLICATIONS

This Utility Patent Application claims the benefit of earlier filed U.S. Provisional Patent Application No. 61/644,093 filed on Jun. 25, 2012 and titled Floating Marine Dock and Connection System. The entire contents of the identified earlier filed U.S. Provisional Application is incorporated herein by this reference.

BACKGROUND OF INVENTION

1. Field of Invention

This invention relates to floating marine docks, and more particularly to a floating marine dock system having elongate rectilinear buoyancy elements of extruded thermal plastic filled with buoyant foam, a connecting system and decking for the dock system.

2. Background and Description of Prior Art

Floating marine docks typically comprise a dock frame formed of wood or metal supported by buoyancy elements and a deck structure, typically of wood planks attached to the dock frame. Known buoyancy elements include closed-cell foam slabs such as rigid Styrofoam®, drums of plastic or steel, molded plastic floats and cedar logs. Unfortunately, foam slabs are difficult to attach to the dock frame and are often detached from the dock frame and lost during storms, or are destroyed by water dwelling rodents that bore into the foam to make nests. Drums (plastic or steel) are likewise difficult to attach to the dock frame, and if perforated by rust, or otherwise flooded, lose their buoyancy and sink. Plastic floats are expensive to form and, if punctured, also flood and sink. Cedar logs are massive both in size and weight, expensive, difficult to transport, are subject to boring worms in salt water environments, and eventually become water logged and sink.

The physics of flotation require that the weight of the entire dock structure (buoyancy elements, dock frame, deck structure, accessories and any supported load such as people) must be less than the weight of the fluid medium (water) displaced by the buoyancy elements. As a result, it is commonly desirable to use buoyancy elements that have a large surface area such as the rectilinear floats shown in U.S. Pat. No. 5,281,055 to Neitzke, et al. or U.S. Pat. No. 8,292,547 B2 to Johannek, et al. These buoyancy elements, because of the large surface area, rest on or near the surface of the fluid medium (water) and do not penetrate deeply into the water even when supporting heavy loads.

Buoyancy elements having large surface areas are well known and commonly used, but also have the undesirable effect of being unstable when loaded unevenly and also of blocking natural sunlight from reaching the water surface. In certain federally protected waterways, such as, but not limited to, the Snake River in the states of Washington and Idaho, the Federal Endangered Species Act (ESA) mandates all floating dock structures pass a minimum of 50% sunlight to the water surface to enhance marine habitat and to protect various aquatic species, both flora and fauna. Even when a floating dock is "decked" with a porous material, such as "Expanded Wire Mesh" which allows sunlight to pass therethrough, the ESA requirements of the sunlight pass-through is difficult, and nearly impossible to attain with known floating dock structures that use a plurality of closely spaced buoyancy elements. Therefore, there remains a need for a floating dock system that can be used in federally protected waterways including, but not limited to, the Snake River which comply with and satisfy the requirements of the Endangered Species Act.

Floating dock systems typically include one or more floating segments creating dock systems with the floating segments joined together by pins, hinges, chains or other known connection methods. However, known floating dock systems and known connection methods suffer from numerous shortcomings, including, but not limited to, difficulty in assembly, poor cosmetic appearance due to exposed hardware, and lower than desired stability. Further, because floating dock systems are massive in size, and can be enormously heavy (e.g. cedar log floats) the number of locations where a dock segment and/or system may be built/constructed is limited thus making floating marine docks expensive. Therefore, a continuing need exists for an improved floating dock system.

Our floating marine dock and connection system resolves various of the aforementioned problems associated with known floating docks and dock systems and further satisfies the requirements of the Federal Endangered Species Act by providing a floating marine dock that utilizes a plurality of buoyancy elements formed of extruded polyethylene plastic in a rectilinear configuration having a preferred width to height ratio of approximately 2-to-1. The buoyancy elements may be extruded in nearly any length. Interior chambers defined by the buoyancy elements are filled with expanded foam to prevent sinking in the event the buoyancy elements become punctured and to prevent collapsing of the buoyancy elements when compressed by fastening straps. End caps heat welded to end portions of the buoyancy elements provide a water tight seal. The end caps may form butt-ends, or may have a truncated configuration carrying a mounting flange.

The buoyancy elements are interconnected to one another using corner braces, connecting straps and connecting bands, and may form a variety of configurations including, but not limited to, structure in the shape of a periphery of a rectangle wherein the center portion of the rectangle remains open. The buoyancy elements are interconnected to one another so that a minor dimension is horizontal and a major dimension is vertical. This unique positioning of the buoyancy elements forces the buoyancy elements more deeply into the water (below the surface of the water) and correspondingly decreases the amount of the surface area of the water that is physically obstructed from passage of natural sunlight.

The connecting bands have a threaded adjustment/tensioning feature and are placed upon and extend about an outer circumference of the buoyancy elements to interconnect the buoyancy elements to one another and to provide a means for mounting a deck structure upon the interconnected buoyancy elements.

Decking may be attached to the interconnected buoyancy elements to extend thereacross and across any open space defined between any spaced apart buoyancy elements. When a decking material, such as expanded wire mesh is used, a sufficient amount of natural sunlight passes therethrough to reach the water surface to satisfy and meet the stringent requirements of the Endangered Species Act.

Other decking materials, such as lumber, wood, synthetic wood and the like may also be fastened to the buoyancy elements and connecting elements to provide a more aesthetically appealing decking assembly. Other desirable dock accessories, such as, but not limited to, cleats, benches, storage lockers, steps, ladders and the like may also be interconnected to and supported by the marine dock.

End-to-end connection of the buoyancy elements may be accomplished by using flanges and connecting bands that allow formation of strong secure butt-joints. End-to-end connections of the buoyancy elements may also be accomplished with truncated flanged end pieces that allow the buoyancy elements to be interconnected with one another to form pontoon type buoyancy elements with extreme lengths. The ability to construct long buoyancy elements increases stability and is especially desirable in commercial operations, such as marinas. Further, the truncated flanged end pieces allow connection fittings, such as bolts, nuts and washers to be moved radially inwardly toward a center of the buoyancy elements so that the connection fittings are not susceptible to being damaged, nor are they a risk to vessels and boats moored to the dock. Braces, coupled with connecting bands extend between spaced apart buoyancy elements to positionally maintain the buoyancy elements as desired and to prevent the buoyancy elements from moving relative to one another. The uniquely configured braces cause minimal light obstruction.

Our floating marine dock and connection system overcomes various of the aforementioned drawbacks by providing a floating marine dock system comprised of plural buoyancy elements having a consistent rectilinear peripheral configuration and of varying lengths, each buoyancy element providing a consistent amount of flotation. Connection fittings provide for interconnection of the buoyancy elements in a variety of configurations allowing a user to create various desirable floating dock configurations. The connection fittings also provide a means for attaching a variety of accessories to the dock assembly. A variety of types of decking may be attached to and supported on the dock assembly and such decking allows our floating dock assembly to comply with the requirements of the Federal Endangered Species Act and also to be aesthetically appealing and desirable. Our floating marine dock and connection system is also lightweight such that the buoyancy elements may be interconnected while on shore and then moved into the water for installation of the decking. Our floating marine dock allows individuals to purchase, build and install floating docks without the need to purchase a dock from a commercial dock building operation and wait extensive periods of time for the dock to be built and installed.

Various of the drawbacks and problems explained above, and other drawbacks and problems, may be helped or solved by our invention shown and described herein. Our invention may also be used to address other problems not set out herein or which become apparent at a later time. The future may also bring to light unknown benefits which may, in the future, be appreciated from the novel invention shown and described herein.

Our invention does not reside in any one of the identified features individually, but rather in the synergistic combination of all of its structures, which give rise to the functions necessarily flowing therefrom as hereinafter specified and claimed.

SUMMARY

A floating marine dock and connection system therefor provides plural elongate rectilinear buoyancy elements having a consistent peripheral configuration with major dimension and a minor dimension and customizable lengths. Connecting apparatus permits the buoyancy elements to be interconnected end-to-end, in parallel and perpendicular to one another. Connection straps extend about the outer peripheral of the buoyancy elements and interconnect with flanges, plates and accessories desirable for marine docks. The connection straps support a nailer beam to which decking is fastened. Braces extend between spacedly adjacent buoyancy elements to maintain the spatial relationship therebetween and to support service conduits.

In providing such a floating marine dock, it is:

a principal object to provide a floating marine dock that is inexpensive and easy to build.

a further object to provide a floating marine dock that provides consistent uniform flotation.

a further object to provide a floating marine dock that it is customizable.

a further object to provide a floating marine dock that satisfies the stringent sunlight passthrough requirements of the Federal Endangered Species Act.

a further object to provide a floating marine dock having end connection fittings that do not extend radially outwardly from the buoyancy elements.

a further object to provide a floating marine dock that may be completely or partially constructed on land and then moved into the water.

a further object to provide a floating marine dock that supports a variety of types of decking.

a further object to provide a floating marine dock that is resistant to water dwelling animals and organisms.

a further object to provide a floating marine dock having a variety of dock accessories.

a further object to provide a floating marine dock using rubber block interconnection means to provide a durable, level and silent interconnection between adjacent dock segments.

a further object to provide a floating marine dock that is easily repairable.

a further object to provide a floating marine dock that has double means of flotation.

a further object to provide a floating marine dock that is resistant to rust damage and puncture damage.

a further object to provide a floating marine dock using buoyancy elements of customizable length.

a further object to provide a floating marine dock wherein the buoyancy elements are positioned so that a minor dimension extends horizontally and a major dimension extends vertically.

Other and further objects of our invention will appear from the following specification and accompanying drawings which form a part hereof. In carrying out the objects of our invention it is to be understood that its structures and features and steps are susceptible to change in design and arrangement and order with only one preferred and practical embodiment of the best known mode being illustrated in the accompanying drawings and specified as is required.

BRIEF DESCRIPTIONS OF DRAWINGS

Specific forms, configurations, embodiments and/or diagrams relating to and helping to describe preferred versions of my invention are explained and characterized herein, often with reference to the accompanying drawings. The drawings and all features shown therein also serve as part of the disclosure of our invention, whether described in text or merely by graphical disclosure alone. Such drawings are briefly described below.

FIG. 26 is an isometric view of a corner gusset.

FIG. 27 is an orthographic top view of a section of expanded wire mesh grating of the type that may be used for decking to allow passage of sunlight, water, snow and the like therethrough.

DESCRIPTION OF PREFERRED EMBODIMENT

Figure 1:
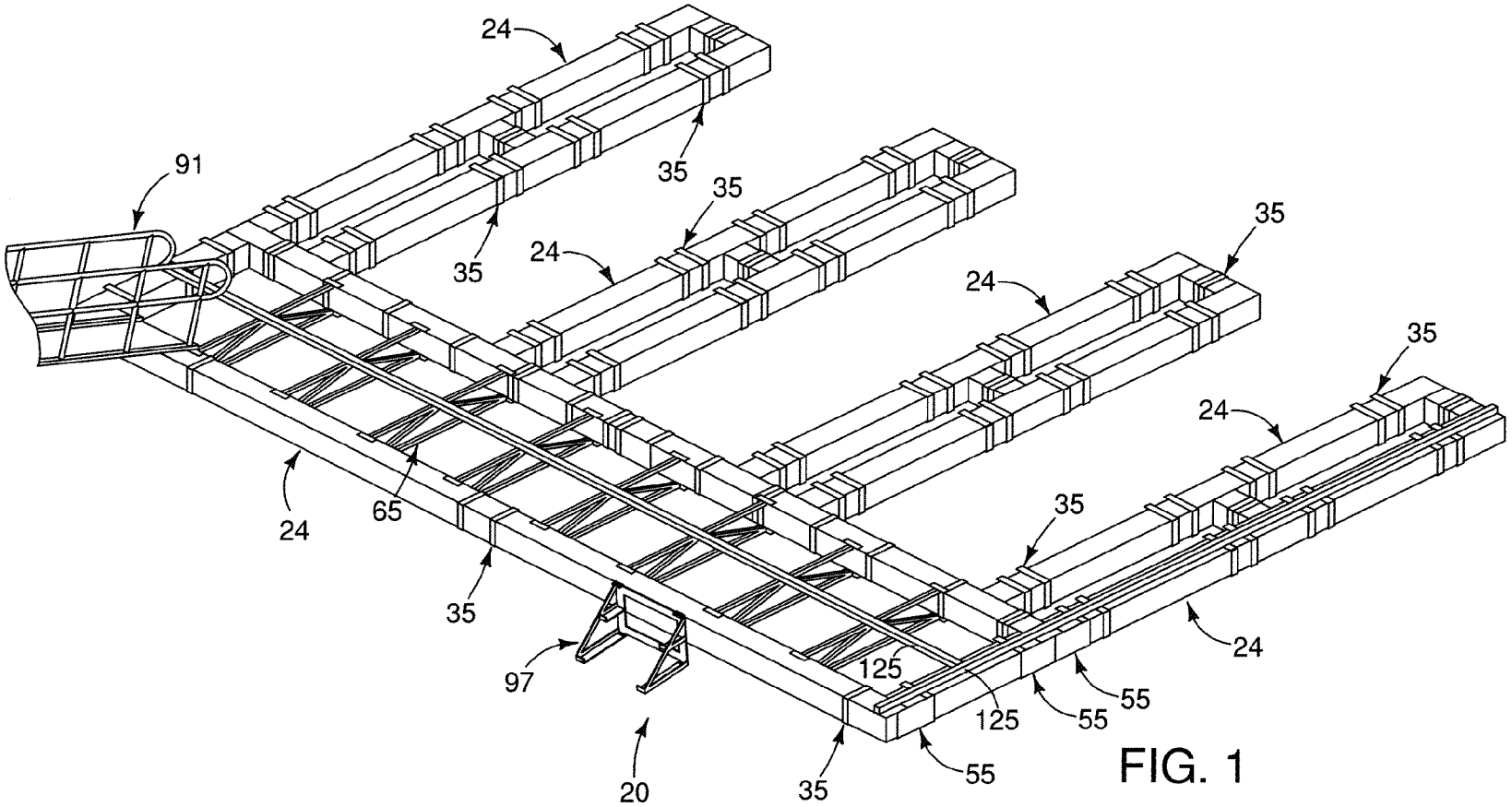
FIG. 1 is an isometric top, side and end view of one possible configuration of a floating marine dock system less the decking.
Figure 4:
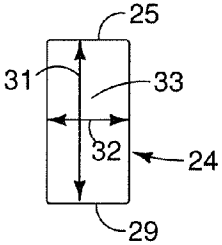
FIG. 4 is an orthographic end view of the buoyancy element of FIG. 2, both ends being the same.
Figure 5:
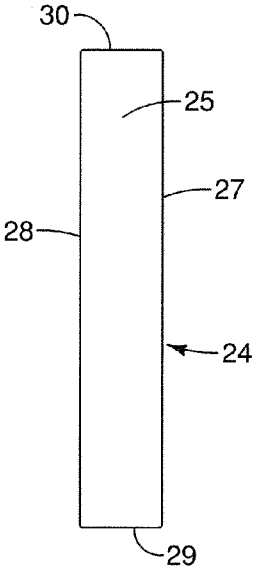
FIG. 5 is an orthographic top view of the buoyancy element of FIG. 2, the bottom view being the same.
Figure 2:
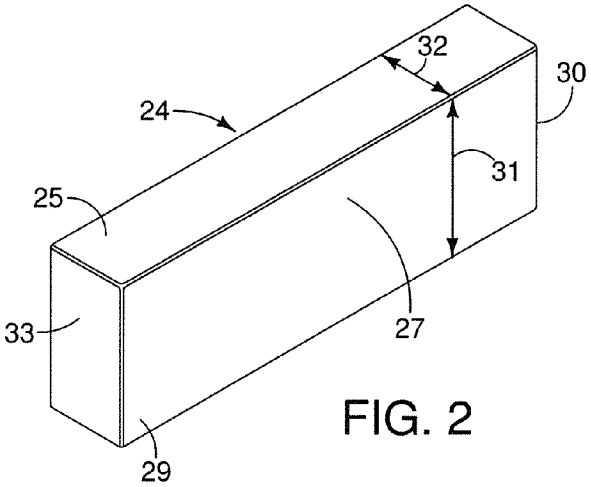
FIG. 2 is an isometric top, side and end view of a buoyancy element.
Figure 3:
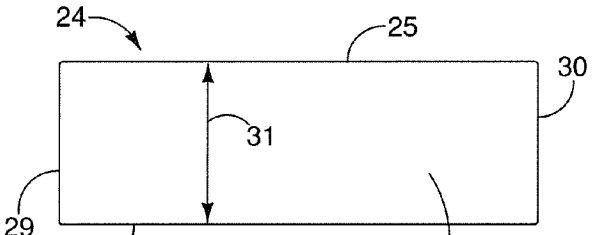
FIG. 3 is an orthographic side view of the buoyancy element of FIG. 2.

The readers of this document should understand that the embodiments described herein may rely on terminology used in any section of this document and other terms readily apparent from the drawings and the language common therefore as may be known in a particular art and known or indicated or provided by dictionaries. Dictionaries were used in the preparation of this document. Widely known and used in the preparation hereof are *Webster's Third New International Dictionary* (©1993), *The Oxford English Dictionary* (Second Edition, ©1989), *The New Century Dictionary* (©2001-2005) and the *American Heritage Dictionary of the English Language* ($4^{th}$ Edition ©2000) all of which are hereby incorporated by this reference for interpretation of terms used herein.

This document is premised upon using one or more terms or features shown in one embodiment that may also apply to or be combined with other embodiments for similar structures, functions, features and aspects of the invention. Wording used in the claims is also descriptive of the invention and the text of both claims and abstract are incorporated by reference into the description entirely.

Our floating marine dock 20 generally provides plural buoyancy elements 24 (hereinafter referred to as flotation pontoons 24), a deck frame 130, a deck 108, connection bands 35, corner supports 46, flanges 55, braces 65 and various dock accessories that may be fastened to the dock 20.

The flotation pontoons 24 are preferably formed of a thermal plastic, such as, but not limited to, extruded or roto-molded high density polyethylene, and each has a top portion 25, a bottom portion 26, a first side portion 27, a second side portion 28, a first end 29, a second end 30 and defines a medial chamber. (not shown). Each flotation pontoon 24 preferably has a cross-sectional shape of a rectangle with a major dimension 31 extending between the top portion 25 to the bottom portion 26 and a minor dimension 32 extending between the first side portion 27 and the second side portion 28. End caps 33 are carried the first and second ends 29, 30, respectively, of each flotation pontoon 24 and the end caps 33 are integrally connected to the flotation pontoons 24 such as by plastic welding to provide a durable, strong, watertight and airtight seal therebetween. The medial chamber (not shown), defined by each flotation pontoon 24, is filled with an expanding foam, such as, but not limited to, Styrofoam® to maintain buoyancy in the event the flotation pontoon 24 is punctured, and also to prevent the flotation pontoon 24 from collapsing when compressed by the connection bands 35 and/or ice in freezing environments. Because the flotation pontoons 24 are formed of a thermal plastic, such as, but not limited to, high density polyethylene, the flotation pontoons 24 may be roto-molded by known means or may be extruded by known means and therefore are capable of being formed in nearly any length and with nearly any height to width dimension. In the preferred embodiment, the height to width dimension is preferably two-to-one, for example 24"×12". Further, the high density polyethylene (thermoplastic) construction allows heat welded joining of the end caps 33, and also provides a means for repairing any damage the flotation pontoon 24 may suffer during use. Roto-molding formation, or extrusion formation of the flotation pontoons 24 further allows fastener/connection flanges (not shown) to be integrally molded into the pontoons 24 for attachment of the deck frame 130.

The thermoplastic material of the flotation pontoons 24 allows service conduits 129 which are pipe-like passage ways passing through the medial chamber (not shown) between the first and second side portions 27, 28, respectively, and between the top and bottom portions 25, 26 respectively of the flotation pontoon 24 to be installed at desired locations to carry services (not shown) such as electrical power and potable water. Service conduits 129 may be similarly installed by forming aligned holes in opposing first and second side portions 27, 28 respectively, of the flotation pontoons 24, passing a pipe (not shown) of the same thermoplastic material therethrough, and then heat welding the pipe (not shown), to the flotation pontoons 24 at the adjoining surfaces with known thermoplastic heat welding apparatus and methods (not shown) which melt the plastic of the pipe (not shown) and adjacent surfaces of the flotation pontoon 24 together to form a strong watertight and airtight seam therebetween.

End caps 33 may be planer and extend between the top portion 25 and the bottom portion 26 and between the first side portion 27 and the second side portion 28 at the first end 29 and at the second end 30 of each flotation pontoon 24 providing a strong, watertight and airtight end to the flotation pontoon 24 and effectively sealing the medial chamber (not shown) of the flotation pontoon 24. In the preferred embodiment, the end caps 33 are formed of the same material from which the flotation pontoons 24 are extruded. As a result, the end caps 33 may be heat welded to the ends 29, 30 of the flotation pontoons 24 which provides a seamless joint therebetween.

Figure 25:
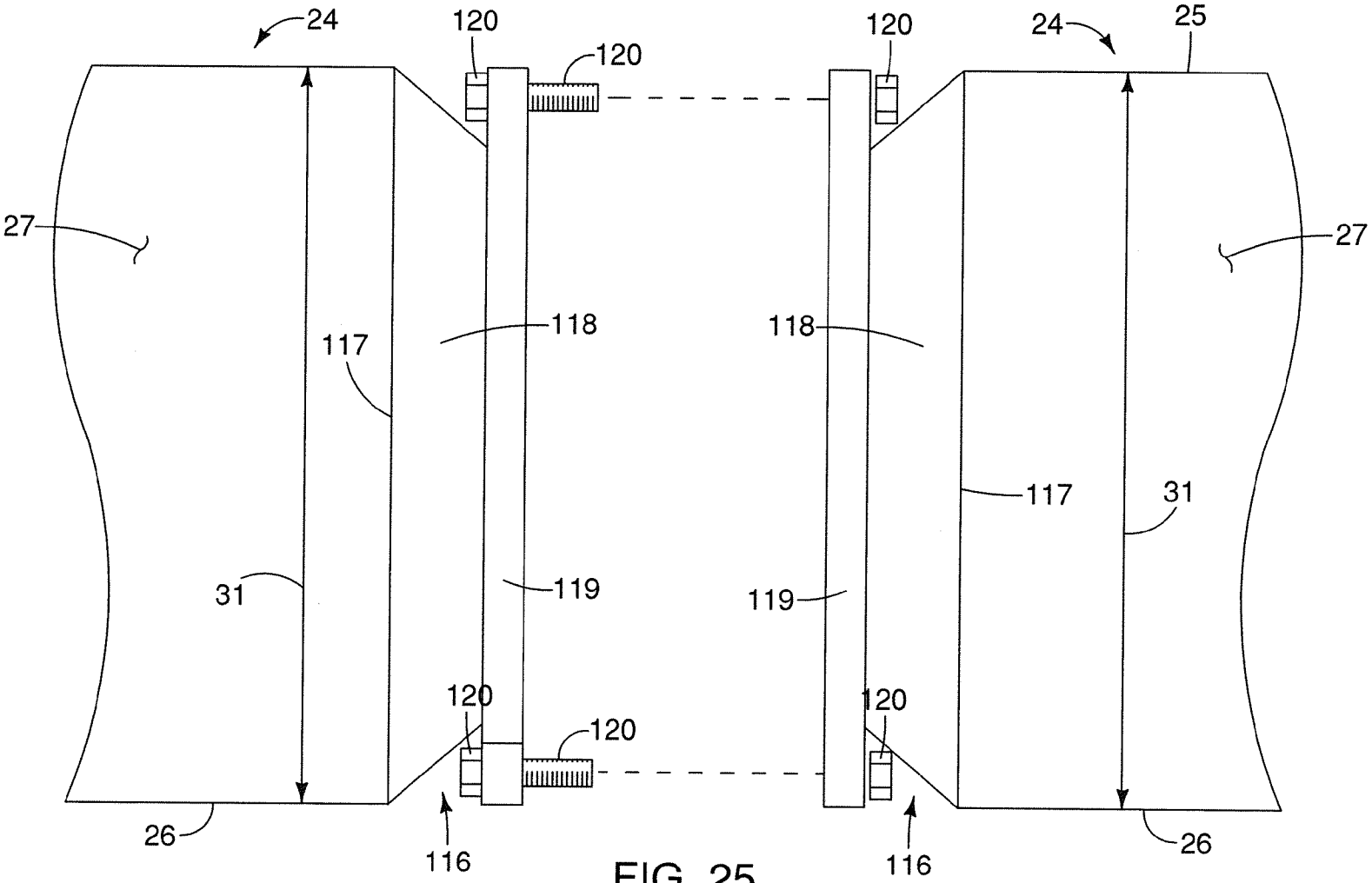
FIG. 25 is a partial cutaway orthographic side view of the truncated conic flange connection system for the buoyancy elements.

As shown in FIG. 25, in another preferred embodiment, truncated end caps 116 may also be heat welded to the first and second ends 29, 30, respectively of the flotation pontoons 24. Each truncated end cap 116 has an angulated truncation wall 118 structurally joined to the flotation pontoon 24. The truncation wall 118 is angulated inwardly relative to the first and second sides 25, 26, respectively, and top and bottom 27, 28 respectively of the flotation pontoon 24. A flange 119 is carried by the truncation wall 118 opposite the flotation pontoon 24. The flange 119 extends radially outwardly from the truncation wall 118 opposite the flotation pontoon 24 a radial distance sufficient so that an outward most edge of the flange 119 is co-planar with the flotation pontoon 24 first and second sides 25, 26 and top and bottom 27, 28. Fastener holes (not shown) are defined in the flange 119 and are spacedly arrayed thereabout so that the flotation pontoons 24 may be securely interconnected with one another in an end-to-end orientation with known fasteners 120 extending through the fastener holes (not shown). The angulated truncation wall 118, and the flange 119 allow the fasteners 120 to be positioned radially inwardly from the outer peripheral surfaces of the flotation pontoons 24. Placement of the fasteners 120 and related hardware at this radially inward position prevents the fasteners 120 and associated connection hardware from posing a risk to vessels moored to the dock assembly 20.

Figure 6:
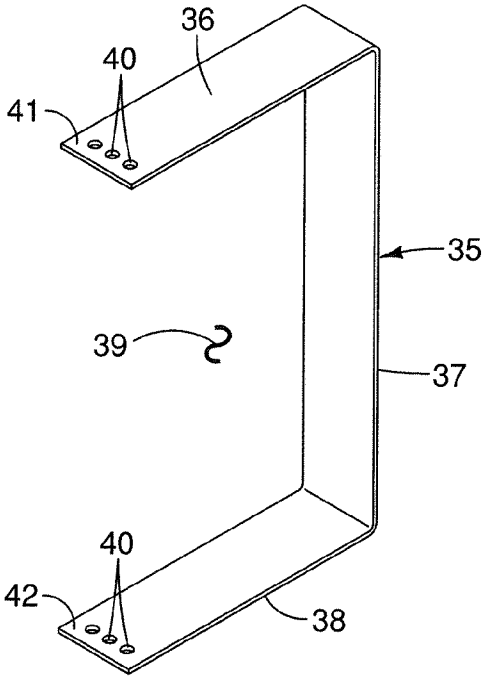
FIG. 6 is an isometric top, side and front view of a connection band.
Figure 28:
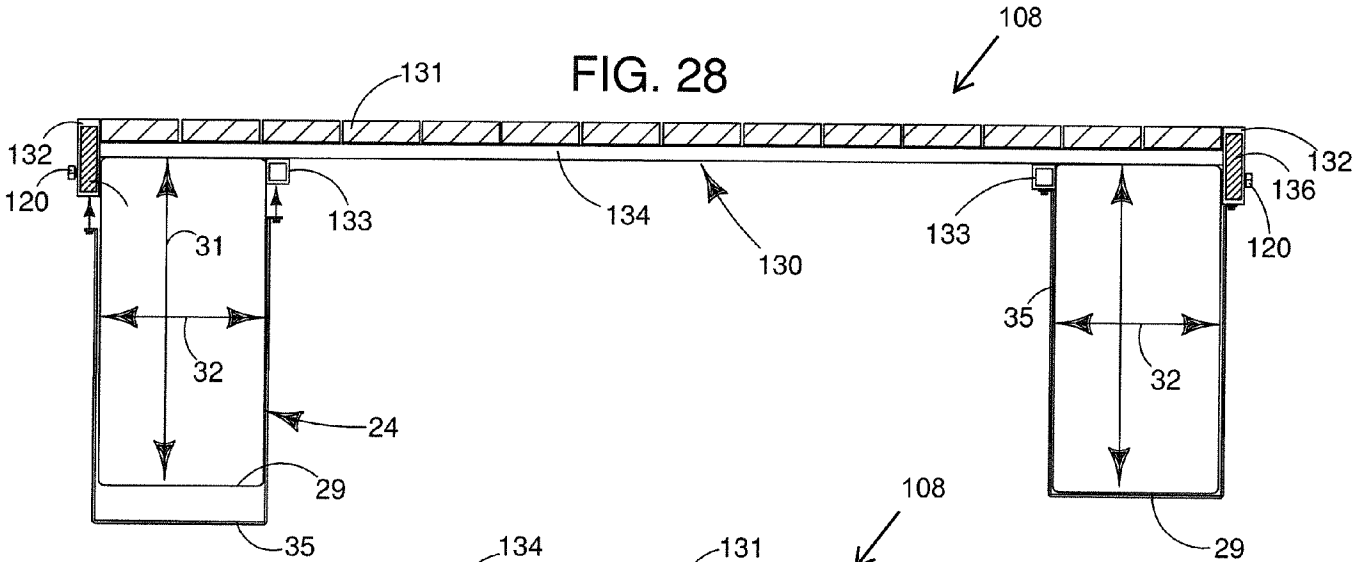
FIG. 28 is an orthographic end view of a dock assembly showing a second embodiment of the deck frame carrying wood plank decking.

Connection band 35 (FIG. 6) is preferably formed single piece of galvanized steel and has a general configuration of a "C" with a first leg 36, a perpendicular second leg 37 and a third leg 38 extending parallel to and in the same direction as the first leg 36. The connection band 35 defines an interior space 39 between the first leg 36 and the third leg 38 adjacent to the second leg 37. The first leg 36 and the third leg 38 each have an end portion 41, 42 respectively opposite the second leg 37 that defines plural spacedly arrayed fastener holes 40. Length of the first leg 36 and length of the third leg 38 is slightly greater than one dimension 31, 32 of the flotation pontoon 24. Length of the second leg 37 is substantially the same as the other dimension 31, 32 of the flotation pontoon 24 so that the connection band 35 may extend about an outer peripheral surface 34 of the flotation pontoon 24 at any position along the length of the flotation pontoon 24 either horizontally (FIG. 15) or vertically (FIG. 28). End portions 41, 42 of the first and third legs 36, 38 respectively may be bent angularly relative to the legs 36, 38 as needed to make the desired connection.

Figure 12:
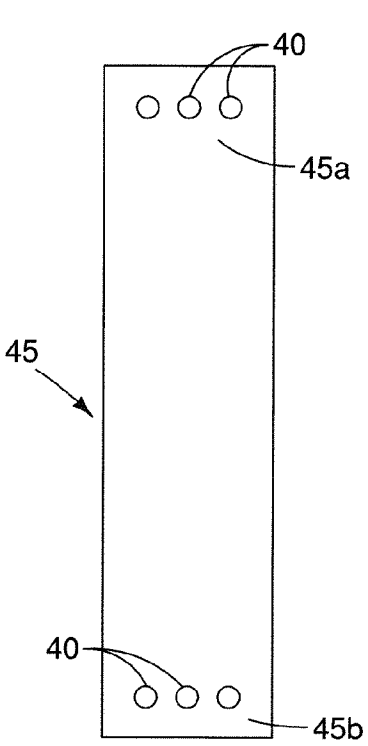
FIG. 12 is an orthographic side view of the connection strap of FIG. 11.
Figure 11:
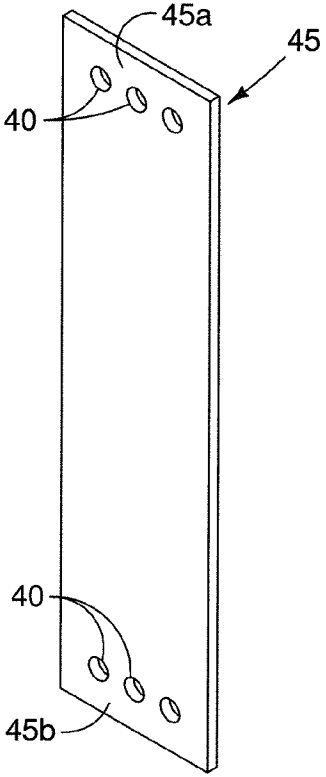
FIG. 11 is an isometric top, side and edge view of a connection strap.
Figure 10:
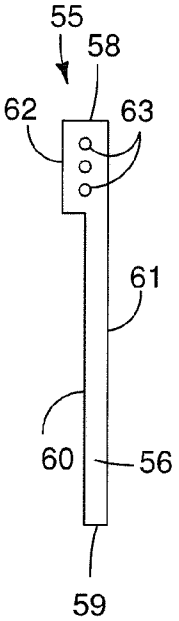
FIG. 10 is an orthographic bottom view of the connection flange of FIG. 9, the top view being the same.
Figure 23:
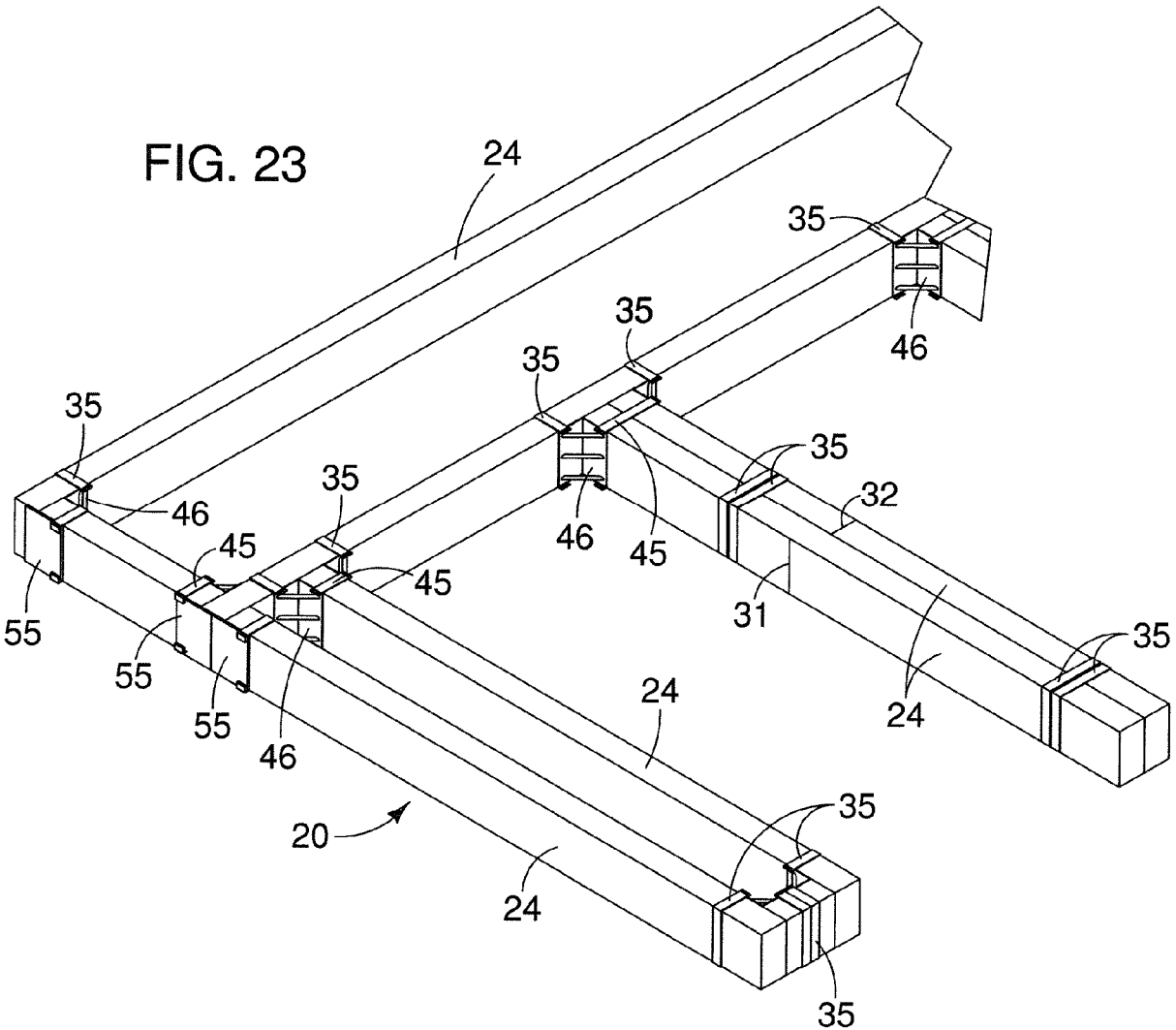
FIG. 23 is a partial cutaway isometric top, side and end view of another configuration of interconnected buoyancy elements showing the arrangement of the various components.

Connection strap 45 (FIGS. 11, 12) is similar in configuration to the first and second legs 36, 38 respectively, of the connection band 35 and defines fastener holes 40 in a first end portion 45A and in a spaced apart second end portion 45B. The connection strap 45 is configured to extend across one dimension 31, 32 of a flotation pontoon 24 such as to interconnect two corner supports 46 where a finger dock 22 is joined to a header dock 21. (FIG. 23). Similar to the connection band 35, the connection strap 45 is preferably formed of galvanized steel.

Figure 24:
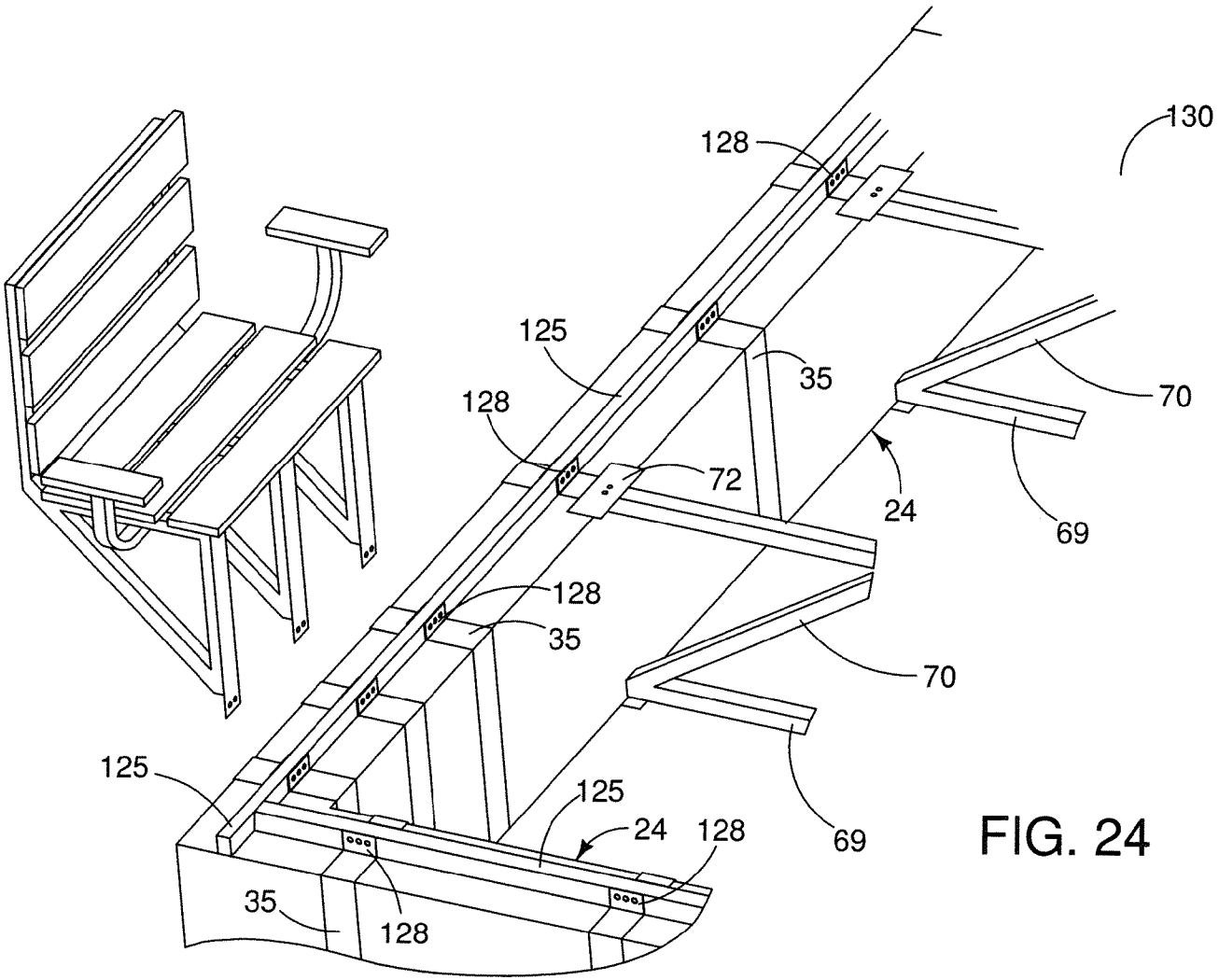
FIG. 24 is a partial cutaway isometric top, side and end view of a portion of a floating marine dock system showing how a bench accessory may be interconnected thereto.

End portion 41 of the first leg 36 and end portion 42 of the third leg 38 of each connection band 35 may extend slightly beyond one dimension 31, 32 of the flotation pontoon 24. The end portions 41, 42 and the fastener holes 40 defined therein provide a means and a location for a deck frame 130 to be attached to the flotation pontoons 24 and connection bands 35 using known brackets (not shown) such as, but not limited to, "angle brackets", using known fasteners (not shown). This connection means is particularly useful if a decking 108 such as expanded wire mesh 137 (FIG. 27) or similar pass-through grating is employed as the decking 108. In another contemplated embodiment, each connection band 35 may carry an upwardly opening "U" shaped saddle 128 on at least one leg 36, 38 of the connection band 35 configured to carry a nailer beam 125 extending between and across spacedly adjacent connection bands 35. (FIG. 24). Nailer beams 125 provide another means for attaching a deck 108 to the flotation pontoons 24, such as, but not limited to, a decking surface 108 formed of wood planks, synthetic wood planks and the like.

Figure 7:
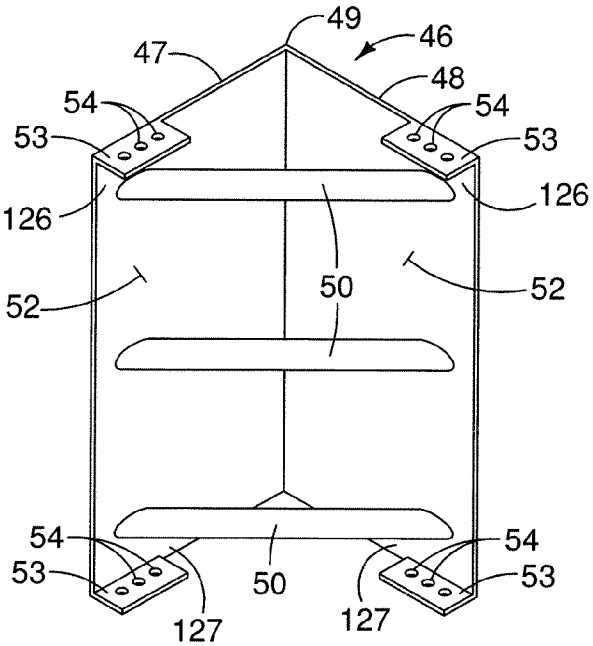
FIG. 7 is an isometric top and rear view of a corner support.
Figure 8:
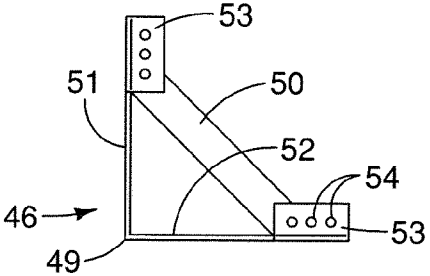
FIG. 8 is an orthographic top view of the corner support of FIG. 7, the bottom view being the same.
Figure 15:
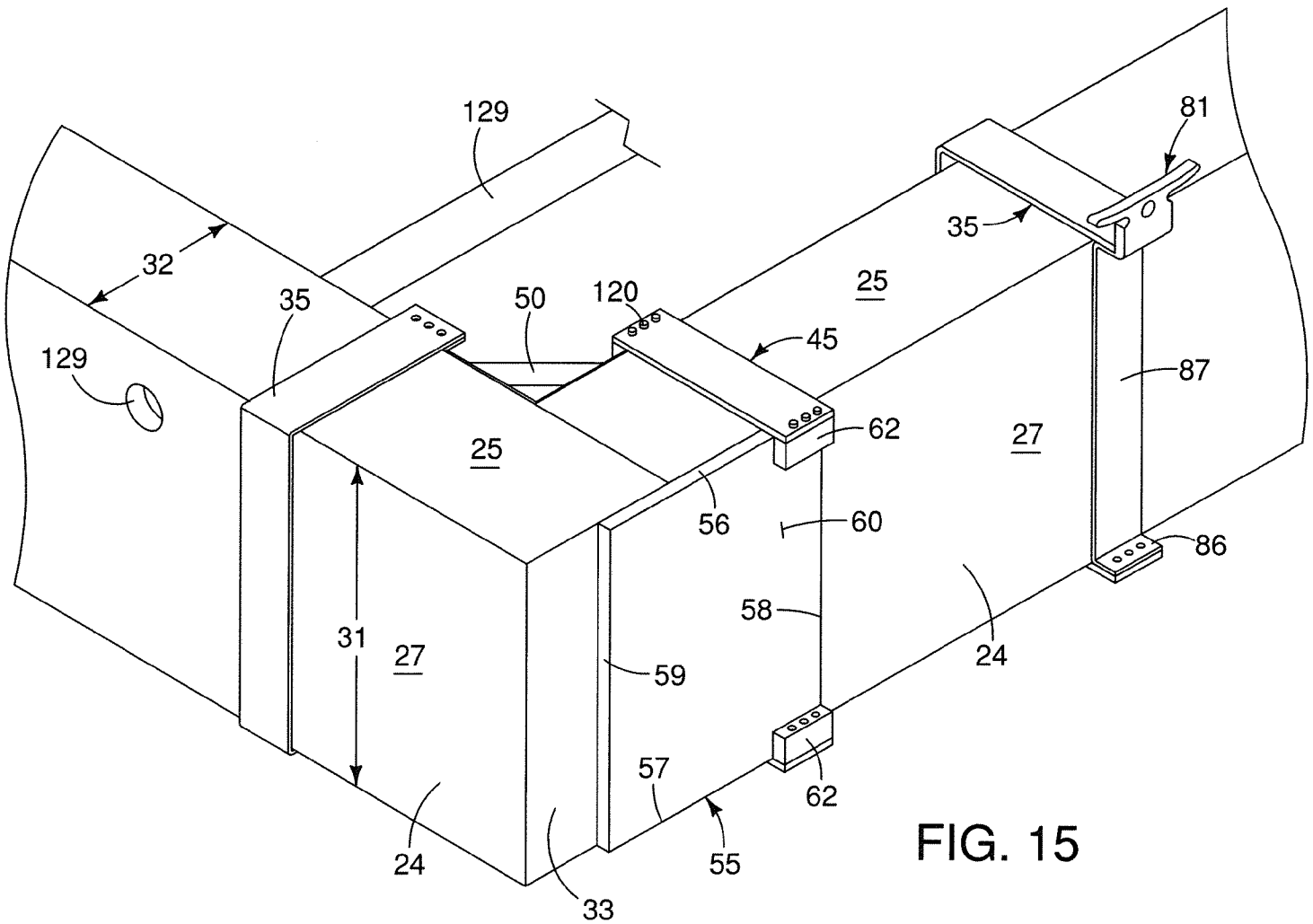
FIG. 15 is an enlarged isometric view of a butt-end corner interconnection showing two buoyancy elements, a connection flange, connection bands and a corner support.
Figure 16:
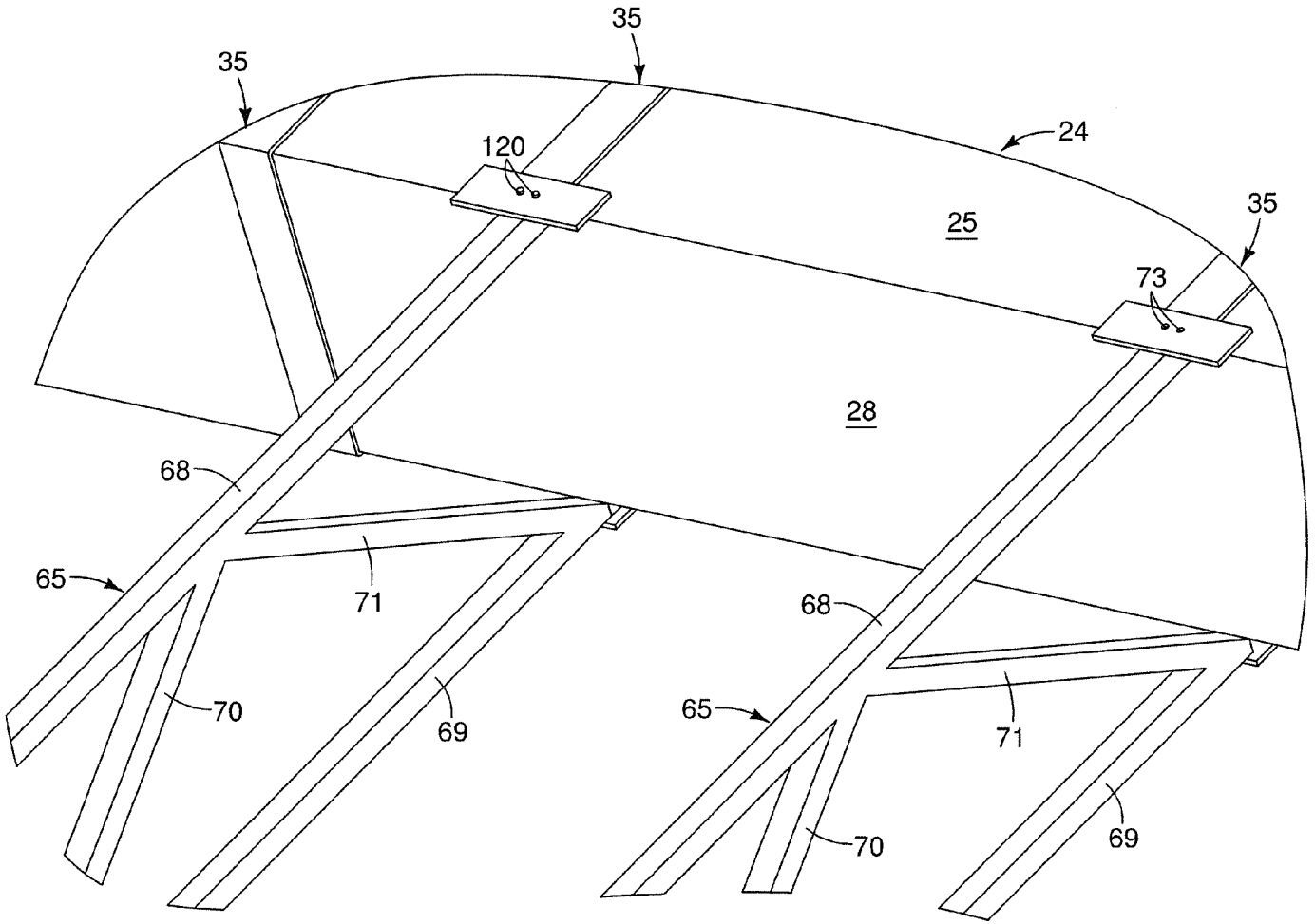
FIG. 16 is an enlarged isometric view of the interconnection of two braces with connection bands extending about a buoyancy element.

Corner support 46 (FIGS. 7, 8) is similar in configuration to a section of angle iron having a first leg 47, a second leg 48 and a corner joint 49 therebetween at adjacent edge portions of the first leg 47 and the second leg 48. The first leg 47 and the second leg 48 each have an outer surface and an inner surface 52. Reinforcement bars 50 communicate between the inner surface 52 of the first leg 47 and the second leg 48 to provide additional strength and structural integrity. Strap connection tabs 53 are carried by the first leg 47 and the second leg 48 at first end portion 126 and opposing second end portion 127 opposite the corner joint 49. Each strap connection tab 53 defines plural spacedly arrayed fastener holes 54 so that the corner supports 46 may be interconnected to the flotation pontoons 24 with connection bands 35 and connection straps 45 extending across the minor dimension 32 with fasteners 120. The corner supports 46 provide added structural integrity at positions where the flotation pontoons 24 are interconnected with one another at right angles, such as where a finger dock 22 joins a header dock 21. (FIG. 15).

Figure 9:
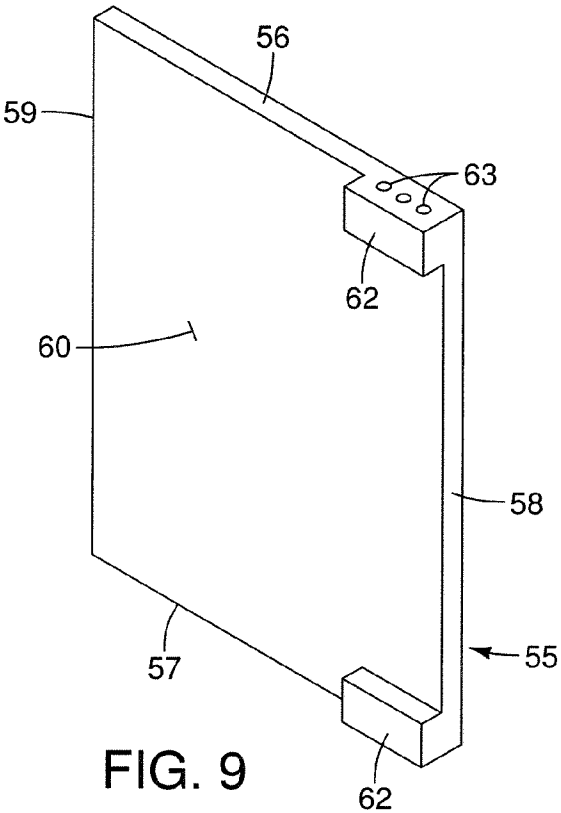
FIG. 9 is an isometric top, side and edge view of a connection flange.

Connection flange 55 (FIG. 9) is generally planer and rectilinear in configuration having a top 56, a bottom 57, a first lateral edge 58, a second lateral edge 59, a first surface 60 and the second surface 61. A connection tab 62 is carried at the top 56 and the bottom 57 adjacent the first lateral edge 58 and extends perpendicularly outwardly from the first surface 60. The connection tab 62 defines plural spacedly arrayed fastener holes 63 therein for engagement with known fasteners 120 to interconnect the connection flange 55 with a connection band 35 or a connection strap 45. As shown in FIG. 15, the connection flange 55, when engaged with a connection strap 45 and corner support 46 provides a means to securely interconnect the flotation pontoons 24 in a butt-joint.

In one preferred embodiment, the connection flange 55 is structurally interconnected, such as by heat welding, to the first side portion 27 or the second side portion 28 of a flotation pontoon 24 at an end portion 29, 30 thereof to eliminate the need for a connection band 35. When heat welded to the flotation pontoon 24 using known thermal plastic welding apparatus and methods the connection flange 55 becomes integral with the flotation pontoon 24 extends beyond the end portion 39, 30 of the flotation pontoon 24 and is coplanar with the side portion 27, 28. The portion of the connection flange 55 extending beyond the end 29, 30 of the flotation pontoon 24 provides a "shelf" against which adjacent flotation pontoons 24 may be secured.

Figure 14:
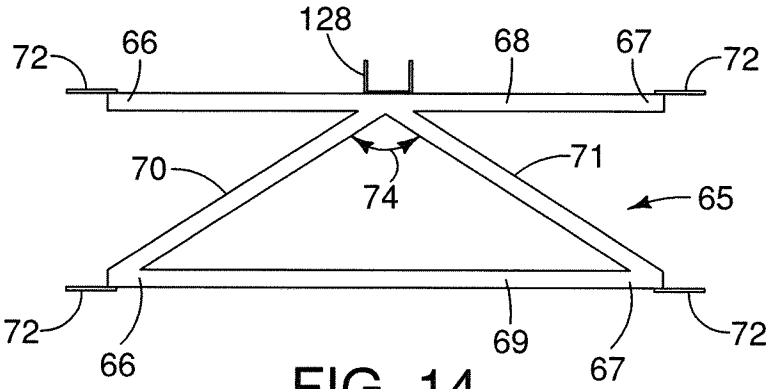
FIG. 14 is an orthographic side view of the brace of FIG. 13.
Figure 13:
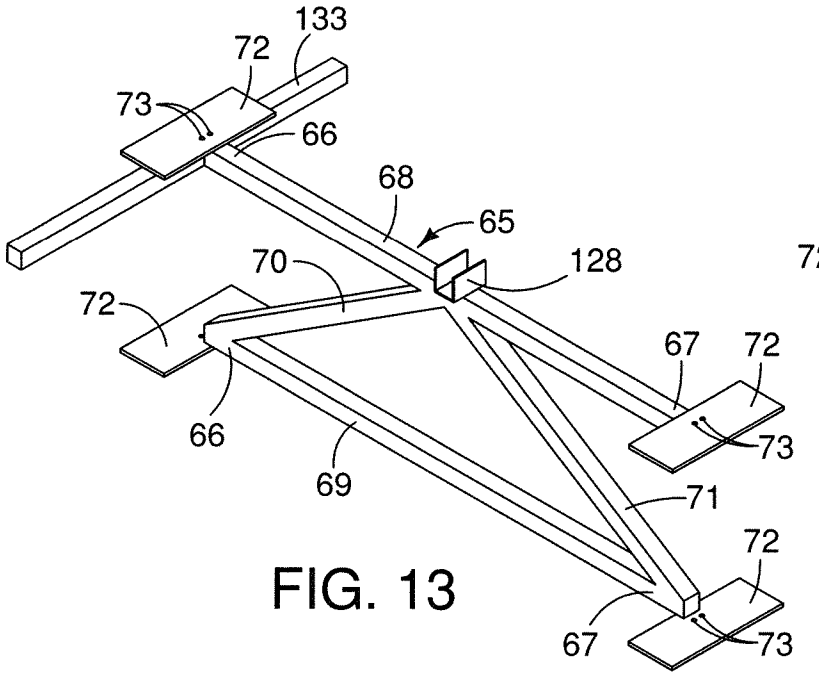
FIG. 13 is an isometric top, side and end view of a brace.

Brace 65 (FIGS. 13, 14) is preferably formed of galvanized steel and has a first end portion 66, a second end portion 67, an upper beam 68, a lower beam 69, a first angulated beam 70, a second angulated beam 71, and structurally carries a flotation pontoon contact plate 72 at each end 66, 67 of each beam 68, 69. Fastener holes 73 are defined in each pontoon contact plate 72 for engagement with known fasteners 120 and with the connection bands 35 extending about an outer peripheral surface 34 of an adjacent flotation pontoon 24. The braces 65, as shown in FIGS. 1, 16, 24 and 29 positionally maintain the flotation pontoons 24 in spaced apart array. Further, the braces 65 may also carry upwardly opening "U" shaped saddles 128 to carry nailer beams 125 for mounting a deck 108 to the dock assembly 20. (FIGS. 13, 14).

Angle 74 between the first angulated beam 70 and the second angulated beam 71 proximate to the upper beam 68 is configured to position lower end portion of each angulated beam 70, 71 vertically downwardly a distance approximately equal to the major dimension 31 of the flotation pontoon 24.

Figure 29:
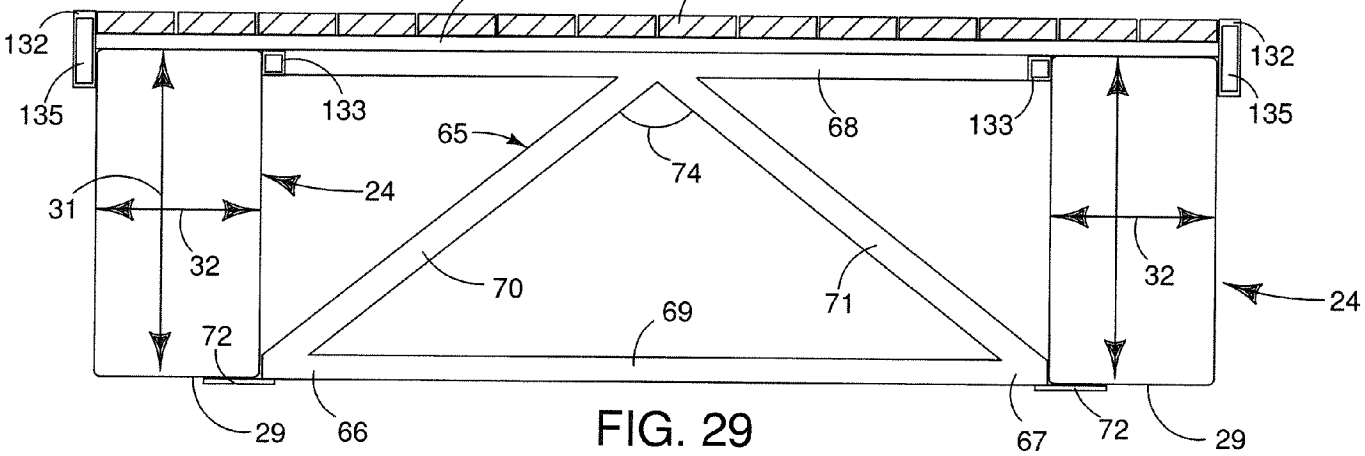
FIG. 29 is an orthographic end view of a dock assembly, similar to that of FIG. 28 showing a brace extending between the spacedly adjacent flotation pontoons.

In another contemplated embodiment, as shown in FIGS. 28 and 29, the deck frame 130 is formed of elongate rectangular box beams 132, square box beams 133 and crossbeams 134. The rectangular box beams 132 are carried adjacent to one side 27, 28 of each flotation pontoon 24 and the elongate square box beams 133 are carried adjacent the opposing side 27, 28 of each flotation pontoon 24 with the flotation pontoon 24 therebetween. The crossbeams 134 extend perpendicular to the rectangular box beams 132 and square box beams 133 and communicate therewith and span a distance to the next spacedly adjacent flotation pontoon 24.

The rectangular box beam 132 and square box beam 133 may be secured to the flotation pontoon 24 using vertically oriented connection bands 35 (FIG. 28) that extend about an outer periphery of the flotation pontoon 24.

The crossbeam 134 is rigidly interconnected to the rectangular box beam 132 and square box beam 133 and provides support for elongate planks 131 providing a deck 108 and also for meshed decking 137 providing a deck 108.

Figure 31:
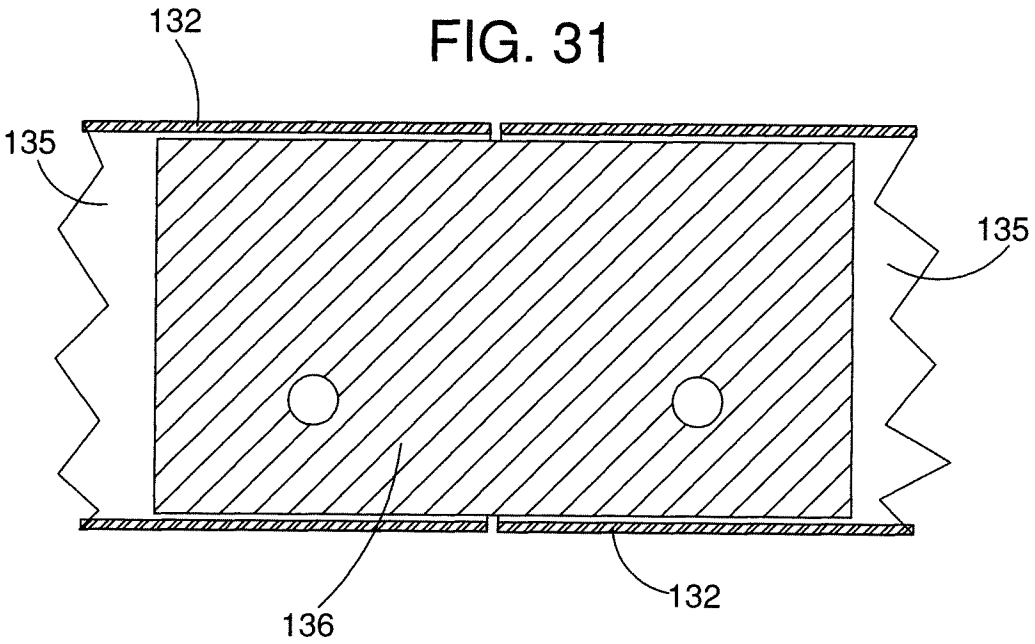
FIG. 31 is an orthographic partial cut-away cross section view of the rectangular box beam of FIG. 30 showing the rubber connection block extending between rectangular box beams of adjacent dock segments, taken on line 31-31 of FIG. 30
Figure 30:
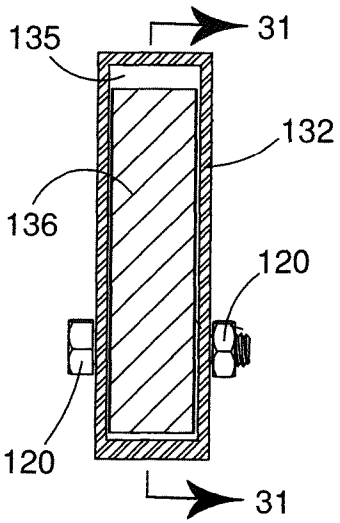
FIG. 30 is an orthographic cross-section of a rectangular box beam of the deck frame showing a rubber connection block within the medial channel.

The rectangular box beam 132 defines a rectangular medial channel 135 extending therethrough. A connection block 136 preferably formed of high density rubber, or similar material that is durable and has some flexibility is carried within the medial channel 135 to extend between adjacent rectangular box beams 132 to provide a durable, level and silent connection means between adjacent dock 20 segments. (FIG. 31). The connection block 136 is positionally secured within the medial channels 135 using known fasteners 120.

Corner gussets 75 (FIG. 26) have a first leg 76, a perpendicular second leg 77 and a hypotenuse 78 opposite a corner 79 where the first leg 76 and second leg 77 are structurally joined. The corner gussets 75 are carried on the dock assembly 20 at positions where a flotation pontoon 24 extends perpendicularly to another flotation pontoon 24. The corner gussets 75 provide additional strength to any decking 108, especially in areas where users may walk across an interior corner.

Figure 17:
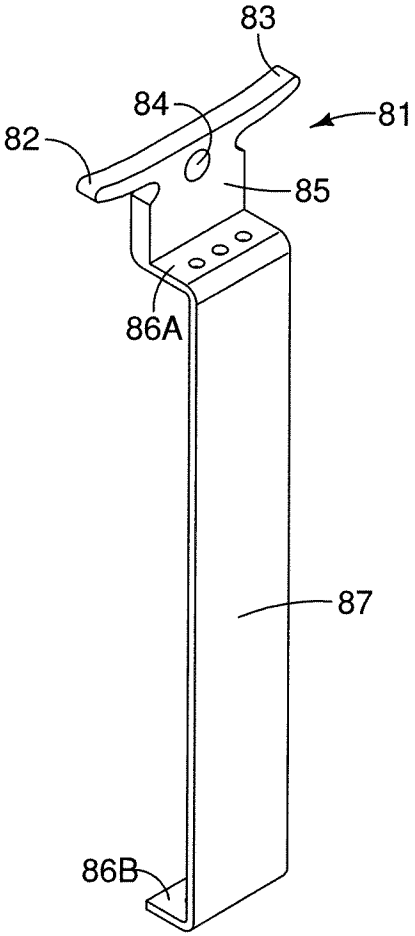
FIG. 17 is an isometric top, side and edge view of a cleat.
Figure 20:
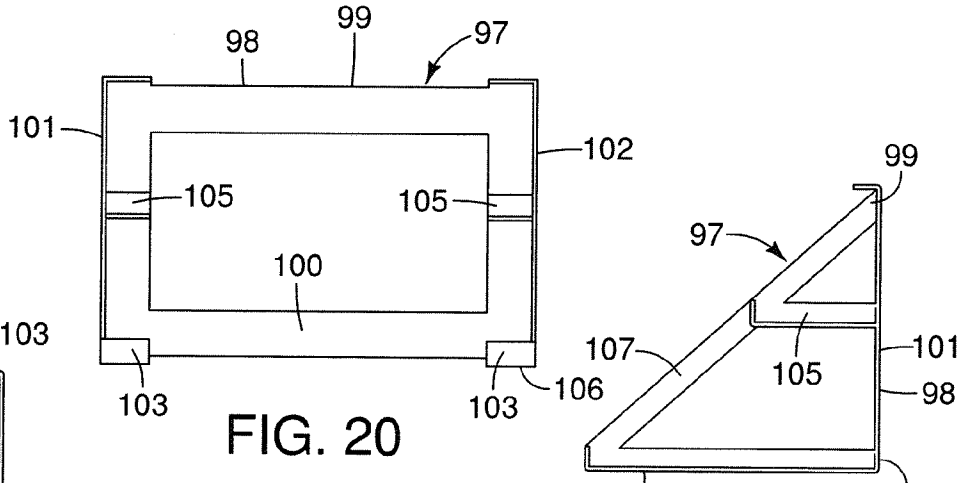
FIG. 20 is an orthographic front view of the step support of FIG. 19.
Figure 22:
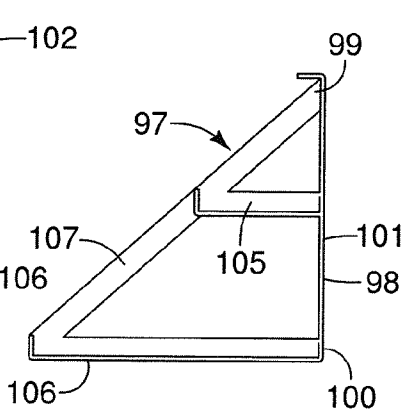
FIG. 22 is an orthographic cross section side view of the step support of FIG. 19 taken on line 22-22 of FIG. 19.
Figure 21:
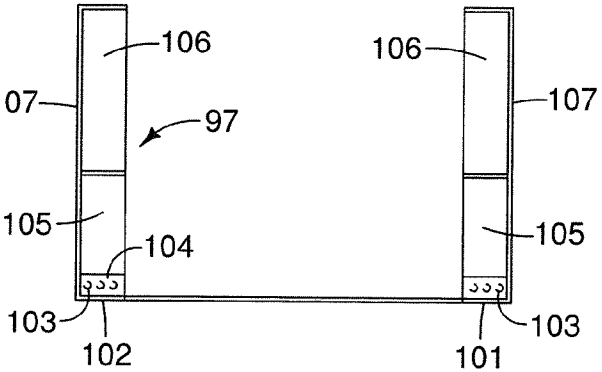
FIG. 21 is an orthographic top, downward looking view, of the step support of FIG. 19.
Figure 19:
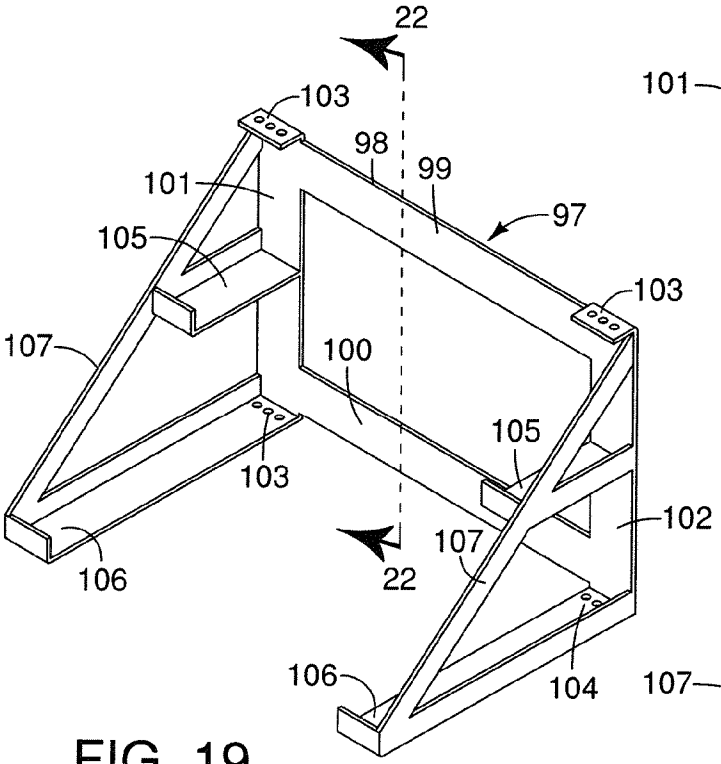
FIG. 19 is an isometric top, side and front view of a step support, less the step planks.

Cleats 81, may be fastened to the flotation pontoons 24 at positions as desired by the user using connection bands 35. As shown in FIG. 17, each cleat 81 has a first cleat arm 82, a second cleat arm 83, a base 85 and a rope hole 84 defined in the base 85. A lower end portion of the base 85 is structurally interconnected to an upper offset leg 86A which communicates with a vertical leg 87. A lower offset leg 86B is carried by the vertical leg 87 opposite the upper offset leg 86A. Each offset leg 86A and 86B define plural fastener holes 86 therein for engagement with known threaded fasteners (not shown) so that each cleat 81 may be secured to a flotation pontoon 24 with a connection band 35. Side to side width 89 of the vertical leg 87 is sufficient to prevent axial twisting of the cleat 81 when the cleat 81 is subjected to forces generated by a vessel (not shown) secured to thereto with a rope. (not shown). Length 90 of the vertical leg 87 is similar to the major dimension 31 of the flotation pontoon 24.

Figure 18:
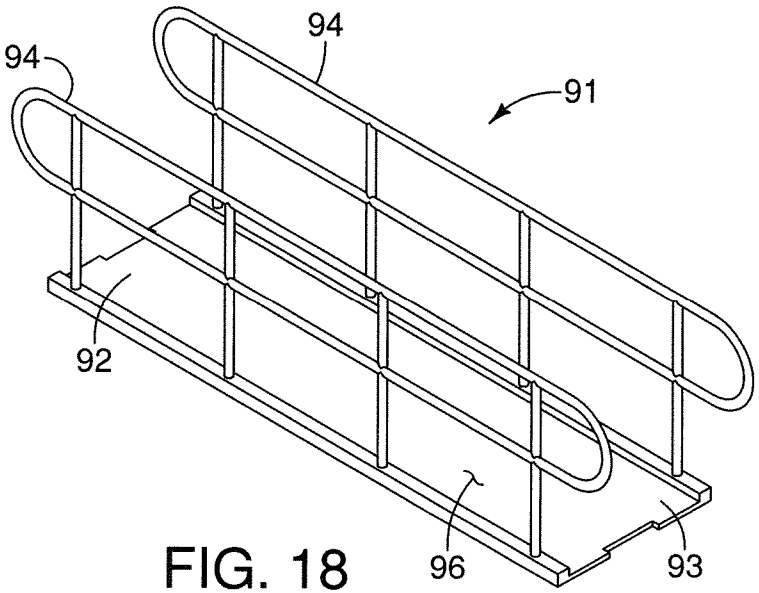
FIG. 18 is an isometric top, side and end view of a gangway.

FIG. 18 shows a known type of the gangway 91 that may be secured to the dock assembly 20 as shown in FIG. 1. The gangway 91 has a first end portion 92, a second end portion 93, handrails 94 and a deck 96 which provides a walking surface for users (not shown) to move from a shore/pier to the dock assembly 20 and from the dock assembly 20 to the shore/pier. (not shown). In the preferred embodiment, one end portion of the gangway 91 is pivotally interconnected to the shore/pier (not shown) about a horizontal axis (not shown) similar to a hinge so that the gangway 91 may pivot relative to the shore/pier as the dock assembly 20 moves up and down vertically as the water level upon which the dock assembly 20 floats changes, such as with incoming and outgoing tides. The opposing end portion of the gangway 91 generally frictionally rests upon an upper surface of the dock assembly 20 deck 108 and is movable thereon using known means such as a horizontal roller to accommodate movement as the dock assembly 20 moves responsive to water level changes and waves.

FIGS. 19-22 show a preferred embodiment of a step support 97 that is attachable to the dock assembly 20 using connection bands 35. The step support 97 has a frame 98 in the general configuration of a rectangle with a top portion 99, a bottom portion 100, a first lateral edge 101, and a second lateral edge 102. Riser supports 107 are structurally connected to the frame 98 along the first and second lateral edges 101, 102 respectively and extend from the top portion 99 downwardly and outwardly toward the bottom portion 100. The riser supports 107 each carry a first riser support 105 proximate the top portion 99 and a second riser support 106 distal from the top portion 99. The second riser support 106 extends horizontally outwardly from the frame 98 a greater distance than the first riser support 105.

Deck 108 is secured to the dock assembly 20 using known fasteners (not shown). The deck 108 in the preferred embodiment is permeable and formed of an expanded wire mesh material 137 (FIG. 27) formed from a material such as galvanized steel or other noncorrosive material including, but not limited to, high density plastics. The wire mesh material 137 is preferable because it defines a plurality of regularly spaced openings within the mesh that allows more than 50% of sunlight striking the deck 108 to pass therethrough to reach the water surface. The more than 50% sunlight pass through satisfies the stringent requirements of the ESA and allows use of our Floating Marine Dock System on Federally protected waterways that are subject to the ESA. Further, the gaps defined in the wire mesh 137 allow water and snow and ice and the like to pass through thereby minimizing slick surfaces and risks associated therewith. As noted previously, a wire mesh 137 deck 108 may be affixed to the dock assembly 20 by passing fasteners (not shown) through the fastener holes 40 defined in the end portions 41, 42 of the connection bands 35. If, on the other hand, decking formed of another material, such as, but not limited to, spaced apart wood planks 131, or perhaps synthetic wood planks such as, but not limited to, Trex® is used to form the deck 108, nailer beams 125 may be fastened in saddles 128 carried on the connection bands 35 and on the braces 65. Decking 108, such as wood planks 131 or Trex® planks would be thereafter fastened to the nailer beams 125 by known means such as, but not limited to, screws. Spacing between the planks 131 allows water, dirt and the like to pass through the deck 108, and makes the deck 108 somewhat permeable.

Having described the structure of our floating marine dock, its operation may be understood.

For construction, the dock assembly 20 may be partially assembled onshore so long as it is possible to thereafter move the partial assembly into the water. The flotation pontoons 24 are positioned as desired by the user, for instance with several flotation pontoons 24 positioned in an end-to-end orientation. Other flotation pontoons 24 may be placed perpendicular to the initially placed flotation pontoons 24. Connection bands 35 are placed about the outer peripheral surface 34 of the flotation pontoons 24 in the locations desired. Assuming truncated end caps 116 are installed on the ends 29, 30 of the flotation pontoons 24, known threaded fasteners 120 are inserted through the aligned fastener holes (not shown) defined in the flanges 119 to secure the flotation pontoons 24 in an end to end relationship.

Corner supports 46 are attached to the flotation pontoons 24 where another flotation pontoon 24 will extend perpendicularly therefrom. Connection bands 35, connection straps 45, and fasteners (not shown) are used to secure the corner supports 46.

After the flotation pontoons 24 have been interconnected, but the assembly is still of a size and weight that it may be moved, the assembly is moved into the water. Any other partial assemblies are similarly built and then moved into the water.

After the partial assemblies are moved into the water, the partial assemblies are interconnected using connection bands 35, connection bands 45, corner supports 46 and flanges 55. If an open center rectangular structure is built, braces 65 are installed with connection straps 35 to strengthen the structure. After the flotation structure has been assembled, nailer beams 125 are placed in the saddles 128. If services are to be provided to the dock assembly 20, wires, pipes and the like are installed in the service conduits 129. Thereafter decking 108 of a desired type may be attached to the nailer beams 125, using known fasteners (not shown).

After completion, or even before completion, the dock assembly 20 is anchored as desired such as with pilings and piling loops (not shown) or submerged anchors and cables/chains (not shown). The various means of securing a floating dock assembly 20 at a position on a waterway are well known in the art.

The above description of our invention has set out various features, functions, methods and other aspects of our invention. This has been done with regard to the currently preferred embodiments thereof. Time and further development may change the manner in which the various aspects are implemented. Such aspects may further be added to by the language of the claims which are incorporated by reference herein. The scope of protection accorded the invention, as defined by the claims, is not intended to be necessarily limited to the specific sizes, shapes, features or other aspects of the currently preferred embodiment shown and described. The claimed invention may be implemented or embodied in other forms still being within the concepts shown, described and claimed herein. Also included are equivalents of the invention which can be made without departing from the scope or concepts properly protected hereby.

The foregoing description of our invention is necessarily of a detailed nature so that a specific embodiment of a best mode may be set forth as is required, but it is to be understood that various modifications of details, sizes, and rearrangement, substitution and multiplication of the parts may be resorted to without departing from its spirit, essence or scope.

Having thusly described our invention, we pray issuance of Utility Letters Patent.

The invention claimed is:

1. A floating marine dock and connection system comprising in combination:

plural flotation pontoons interconnected to one another in spaced array, wherein the plural flotation pontoons include truncated end caps each having a flange and fasteners extending through the flanges creating an end-to-end connection with an adjacent axially aligned flotation pontoon, wherein the fasteners are positioned inwardly from outer peripheral surfaces of the plural flotation pontoons;

a deck frame supported by the plural flotation pontoons and extending across spaces between the spacedly arrayed plural flotation pontoons; and a deck supported by the deck frame.

2. The floating marine dock and connection system of claim 1 wherein:

the plural flotation pontoons are elongate having a generally rectilinear configuration with a major axis and a minor axis and the major axis is generally double the minor axis; and the plural flotation pontoons are oriented relative to the deck frame with the major axis generally vertical and the minor axis generally horizontal.

3. The floating marine dock and connection system of claim 1 wherein:

the plural flotation pontoons are filled with a material having a density less than water.

4. The floating marine dock and connection system of claim 1 wherein:

the plural flotation pontoons are formed of high density thermal plastic that is capable of being formed by rotomolding and extrusion processes and is capable of being heat welded.

5. The floating marine dock and connection system of claim 1 wherein:

the deck is permeable.

6. The floating marine dock and connection system of claim 1 wherein:

the floating marine dock and connection system allows passage of more than 50 percent of sunlight striking the deck to the water surface.

7. The floating marine dock and connection system of claim 1 wherein:

the floating marine dock and connection system allows passage of more than 60 percent of sunlight striking the deck to the water surface.

8. The floating marine dock and connection system of claim 1 further comprising:

an adjustably positionable connection band that extends about a portion of the outer peripheral surface of the plural flotation pontoons and releasably interconnects with corner supports and flanges and braces to maintain the plural flotation pontoons in spaced array.

9. The floating marine dock and connection system of claim 1 further comprising:

a box beam defining a medial channel therethrough carried at each lateral edge of the floating marine dock segment for interconnecting adjacent floating marine dock segments;

a connection block of flexibly resilient material carried partially within the medial channel defined by the box beam of a first floating marine dock segment and partially within the medial channel defined by the box beam of a second floating marine dock segment and bridging a gap between the first and second floating marine dock segments; and a fastener positionally securing the connection block within the medial channel of the box beam.

10. The floating marine dock and connection system of claim 1 wherein:

the deck is formed of a grating material that allows natural light to pass through the grating to reach a water surface thereunder.

11. The floating marine dock and connection system of claim 1 wherein the plural flotation pontoons include:

a first elongate flotation pontoon having a rectangular cross section; and a second elongate flotation pontoon having a rectangular cross section, the second elongate flotation pontoon extending perpendicularly to and interconnected to the first elongate flotation pontoon.

12. The floating marine dock and connection system of claim 11 wherein:

the rectangular cross sections of the first and second elongate flotation pontoons have a major dimension orientated vertically and a minor dimension oriented horizontally.

13. The floating marine dock and connection system of claim 11 further comprising:

a corner support including a first leg and a second leg extending perpendicularly to the first leg, the first leg extending along a first side portion of the first elongate flotation pontoon, the second leg extending along a first side portion of the second elongate flotation pontoon.

14. The floating marine dock and connection system of claim 13 further comprising:

a connection band including a first leg, a second leg extending perpendicularly to the first leg, and a third leg extending parallel to and in the same direction as the first leg, the first leg of the connection band extending along a top portion of the first elongate flotation pontoon and interconnected to the first leg of the corner support, the second leg of the connection band extending along a second side portion of the first elongate flotation pontoon, and the third leg of the connection band extending along a bottom portion of the first elongate flotation pontoon and interconnected to the first leg of the corner support.

15. The floating marine dock and connection system of claim 14 wherein:

the first leg of the corner support includes a first strap connection tab and a second strap connection tab for interconnection to the first leg and the second leg of the connection band.

16. The floating marine dock and connection system of claim 13 further comprising:

a first connection strap extending along a top portion of the second elongate flotation pontoon and interconnected to the second leg of the corner support;

a second connection strap extending along a bottom portion of the second elongate flotation pontoon and interconnected to the second leg of the corner support; and a connection flange extending along a second side portion of the second elongate flotation pontoon and interconnected to the first and second connection straps.

17. The floating marine dock and connection system of claim 16 wherein:

a portion of the connection flange extends beyond an end of the second elongate flotation pontoon and is secured to an end portion of the first elongate flotation pontoon.

18. The floating marine dock and connection system of claim 11 further comprising:

a third elongate flotation pontoon having a rectangular cross section, the third elongate flotation pontoon extending perpendicularly to and interconnected to the first elongate flotation pontoon, the third elongate flotation pontoon extending parallel to and in the same direction as the second elongate flotation pontoon; and a fourth elongate flotation pontoon having a rectangular cross section, the fourth elongate flotation pontoon extending perpendicularly to and interconnected to the second and third elongate flotation pontoons, the fourth elongate flotation pontoon extending parallel to the first elongate flotation pontoon, wherein the first, second, third, and fourth elongate flotation pontoons form a periphery of a rectangular structure having an open center portion.

19. The floating marine dock and connection system of claim 18 further comprising:

one or more braces extending between and interconnected to the second and third elongate flotation pontoons.

20. The floating marine dock and connection system of claim 1 wherein:

the truncated end caps each have a wall angled inwardly from a first side, a second side, a top, and a bottom of the plural flotation pontoons; and the flange is carried by the wall and extends outwardly from the wall.

* * * * *